US006546718B2

(12) United States Patent
Hepburn et al.

(10) Patent No.: US 6,546,718 B2
(45) Date of Patent: Apr. 15, 2003

(54) METHOD AND SYSTEM FOR REDUCING VEHICLE EMISSIONS USING A SENSOR DOWNSTREAM OF AN EMISSION CONTROL DEVICE

(75) Inventors: Jeffrey Scott Hepburn, Birmingham, MI (US); JoAnne Temple, Canton, MI (US); Mark Allen Dearth, Dearborn, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/884,750

(22) Filed: Jun. 19, 2001

(65) Prior Publication Data

US 2002/0189236 A1 Dec. 19, 2002

(51) Int. Cl.[7] ..... F01N 3/00
(52) U.S. Cl. ..... 60/276; 60/274; 60/285
(58) Field of Search ..... 60/274, 276, 285, 60/286, 297, 301, 277; 701/103

(56) References Cited

U.S. PATENT DOCUMENTS

| | | | |
|---|---|---|---|
| 3,696,618 | A | 10/1972 | Boyd et al. |
| 3,969,932 | A | 7/1976 | Rieger et al. |
| 4,033,122 | A | 7/1977 | Masaki et al. |
| 4,036,014 | A | 7/1977 | Ariga |

(List continued on next page.)

FOREIGN PATENT DOCUMENTS

| | | |
|---|---|---|
| DE | 196 07 151 C1 | 7/1997 |
| EP | 0 351 197 A2 | 1/1990 |
| EP | 0 444 783 A1 | 9/1991 |
| EP | 0 503 882 A1 | 9/1992 |

(List continued on next page.)

OTHER PUBLICATIONS

C. D. De Boer et al., "Engineered Control Strategies for Improved Catalytic Control of $NO_x$ in Lean Burn Applications," SAE Technical Paper No. 881595, Oct. 10–13, 1988.
Y. Kaneko et al., "Effect of Air–Fuel Ratio Modulation on Conversion Efficiency of Three–Way Catalysts," SAE Technical Paper No. 780607, Jun. 5–9, 1978, pp. 119–127.
W. H. Holl, "Air–Fuel Control to Reduce Emissions I. Engine–Emissions Relationships," SAE Technical Paper No. 800051, Feb. 25–29, 1980.
A. H. Meitzler, "Application of Exhaust–Gas–Oxygen Sensors to the Study of Storage Effects in Automotive Three–Way Catalysts," SAE Technical Paper No. 800019, Feb. 25–29, 1980.

(List continued on next page.)

*Primary Examiner*—Thomas Denion
*Assistant Examiner*—Binh Tran
(74) *Attorney, Agent, or Firm*—Julia Voutyras; Allan J. Lippa

(57) ABSTRACT

A system and method is provided for controlling a lean-burn engine whose exhaust gas is directed through an exhaust treatment system which includes an emission control device that alternately stores and releases a selected constituent of the exhaust gas, such as $NO_x$, based on engine operating conditions, and a downstream $NO_x$ sensor. The system estimates the concentration of $NO_x$ flowing into the device based on engine operating conditions while determining a value for the concentration of $NO_x$ flowing out of the device based upon the output signal generated by $NO_x$ sensor. A device purge event is scheduled when the device efficiency, calculated based on the $NO_x$ concentrations flowing into and out of the device, falls below a predetermined minimum efficiency value. The length of a purge event is determined as a function of an accumulated measure based on the difference between the $NO_x$ concentrations into and out of the device.

12 Claims, 3 Drawing Sheets

U.S. PATENT DOCUMENTS

| | | | | |
|---|---|---|---|---|
| 4,167,924 | A | | 9/1979 | Carlson et al. |
| 4,178,883 | A | | 12/1979 | Herth |
| 4,186,296 | A | | 1/1980 | Crump, Jr. |
| 4,251,989 | A | | 2/1981 | Norimatsu et al. |
| 4,533,900 | A | | 8/1985 | Muhlberger et al. |
| 4,622,809 | A | | 11/1986 | Abthoff et al. |
| 4,677,955 | A | | 7/1987 | Takao |
| 4,854,123 | A | | 8/1989 | Inoue et al. |
| 4,884,066 | A | | 11/1989 | Miyata et al. |
| 4,913,122 | A | | 4/1990 | Uchida et al. |
| 4,964,272 | A | | 10/1990 | Kayanuma |
| 5,009,210 | A | | 4/1991 | Nakagawa et al. |
| 5,088,281 | A | | 2/1992 | Izutani et al. |
| 5,097,700 | A | | 3/1992 | Nakane |
| 5,165,230 | A | | 11/1992 | Kayanuma et al. |
| 5,174,111 | A | | 12/1992 | Nomura et al. |
| 5,189,876 | A | | 3/1993 | Hirota et al. |
| 5,201,802 | A | | 4/1993 | Hirota et al. |
| 5,209,061 | A | | 5/1993 | Takeshima |
| 5,222,471 | A | | 6/1993 | Stueven |
| 5,233,830 | A | | 8/1993 | Takeshima et al. |
| 5,267,439 | A | | 12/1993 | Raff et al. |
| 5,270,024 | A | | 12/1993 | Kasahara et al. |
| 5,272,871 | A | | 12/1993 | Oshima et al. |
| 5,325,664 | A | | 7/1994 | Seki et al. |
| 5,331,809 | A | | 7/1994 | Takeshima et al. |
| 5,335,538 | A | | 8/1994 | Blischke et al. |
| 5,357,750 | A | | 10/1994 | Ito et al. |
| 5,359,852 | A | | 11/1994 | Curran et al. |
| 5,377,484 | A | | 1/1995 | Shimizu |
| 5,402,641 | A | | 4/1995 | Katoh et al. |
| 5,410,873 | A | | 5/1995 | Tashiro |
| 5,412,945 | A | | 5/1995 | Katoh et al. |
| 5,412,946 | A | | 5/1995 | Oshima et al. |
| 5,414,994 | A | | 5/1995 | Cullen et al. |
| 5,419,122 | A | | 5/1995 | Tabe et al. |
| 5,423,181 | A | | 6/1995 | Katoh et al. |
| 5,426,934 | A | | 6/1995 | Hunt et al. |
| 5,433,074 | A | | 7/1995 | Seto et al. |
| 5,437,153 | A | * | 8/1995 | Takeshima et al. ..... 60/276 |
| 5,448,886 | A | | 9/1995 | Toyoda |
| 5,448,887 | A | | 9/1995 | Takeshima |
| 5,450,722 | A | | 9/1995 | Takeshima et al. |
| 5,452,576 | A | | 9/1995 | Hamburg et al. |
| 5,472,673 | A | | 12/1995 | Goto et al. |
| 5,473,887 | A | | 12/1995 | Takeshima et al. |
| 5,473,890 | A | | 12/1995 | Takeshima et al. |
| 5,483,795 | A | | 1/1996 | Katoh et al. |
| 5,531,972 | A | | 7/1996 | Rudy |
| 5,544,482 | A | | 8/1996 | Matsumoto et al. |
| 5,551,231 | A | | 9/1996 | Tanaka et al. |
| 5,554,269 | A | | 9/1996 | Joseph et al. |
| 5,569,848 | A | | 10/1996 | Sharp |
| 5,577,382 | A | | 11/1996 | Kihara et al. |
| 5,595,060 | A | | 1/1997 | Togai et al. |
| 5,598,703 | A | | 2/1997 | Hamburg et al. |
| 5,617,722 | A | | 4/1997 | Takaku |
| 5,622,047 | A | | 4/1997 | Yamashita et al. |
| 5,626,014 | A | | 5/1997 | Hepburn et al. |
| 5,626,117 | A | | 5/1997 | Wright et al. |
| 5,655,363 | A | | 8/1997 | Ito et al. |
| 5,657,625 | A | | 8/1997 | Koga et al. |
| 5,693,877 | A | | 12/1997 | Ohsuga et al. |
| 5,713,199 | A | | 2/1998 | Takeshima et al. |
| 5,715,679 | A | | 2/1998 | Asanuma et al. |
| 5,722,236 | A | | 3/1998 | Cullen et al. |
| 5,724,808 | A | | 3/1998 | Ito et al. |
| 5,729,971 | A | | 3/1998 | Matsuno et al. |
| 5,732,554 | A | | 3/1998 | Sasaki et al. |
| 5,735,119 | A | | 4/1998 | Asanuma et al. |
| 5,737,917 | A | | 4/1998 | Nagai |
| 5,740,669 | A | | 4/1998 | Kinugasa et al. |
| 5,743,084 | A | | 4/1998 | Hepburn |
| 5,743,086 | A | | 4/1998 | Nagai |
| 5,746,049 | A | | 5/1998 | Cullen et al. |
| 5,746,052 | A | | 5/1998 | Kinugasa et al. |
| 5,752,492 | A | | 5/1998 | Kato et al. |
| 5,771,685 | A | | 6/1998 | Hepburn |
| 5,771,686 | A | | 6/1998 | Pischinger et al. |
| 5,778,666 | A | | 7/1998 | Cullen et al. |
| 5,792,436 | A | | 8/1998 | Feeley et al. |
| 5,802,843 | A | | 9/1998 | Kurihara et al. |
| 5,803,048 | A | | 9/1998 | Yano et al. |
| 5,806,306 | A | | 9/1998 | Okamoto et al. |
| 5,813,387 | A | | 9/1998 | Minowa et al. |
| 5,831,267 | A | | 11/1998 | Jack et al. |
| 5,832,722 | A | | 11/1998 | Cullen et al. |
| 5,842,339 | A | | 12/1998 | Bush et al. |
| 5,842,340 | A | | 12/1998 | Bush et al. |
| 5,862,661 | A | | 1/1999 | Zhang et al. |
| 5,865,027 | A | | 2/1999 | Hanafusa et al. |
| 5,867,983 | A | | 2/1999 | Otani |
| 5,877,413 | A | | 3/1999 | Hamburg et al. |
| 5,910,096 | A | | 6/1999 | Hepburn et al. |
| 5,929,320 | A | | 7/1999 | Yoo |
| 5,934,072 | A | | 8/1999 | Hirota et al. |
| 5,938,715 | A | | 8/1999 | Zhang et al. |
| 5,953,907 | A | | 9/1999 | Kato et al. |
| 5,966,930 | A | | 10/1999 | Hatano et al. |
| 5,970,707 | A | | 10/1999 | Sawada et al. |
| 5,974,788 | A | | 11/1999 | Hepburn et al. |
| 5,974,791 | A | | 11/1999 | Hirota et al. |
| 5,974,793 | A | | 11/1999 | Kinugasa et al. |
| 5,974,794 | A | | 11/1999 | Gotoh et al. |
| 5,979,161 | A | | 11/1999 | Hanafusa et al. |
| 5,979,404 | A | | 11/1999 | Minowa et al. |
| 5,983,627 | A | | 11/1999 | Asik |
| 5,992,142 | A | | 11/1999 | Pott |
| 5,996,338 | A | | 12/1999 | Hirota |
| 6,003,308 | A | | 12/1999 | Tsutsumi et al. |
| 6,012,282 | A | | 1/2000 | Kato et al. |
| 6,012,428 | A | | 1/2000 | Yano et al. |
| 6,014,859 | A | | 1/2000 | Yoshizaki et al. |
| 6,023,929 | A | | 2/2000 | Ma |
| 6,026,640 | A | | 2/2000 | Kato et al. |
| 6,058,700 | A | | 5/2000 | Yamashita et al. |
| 6,073,440 | A | | 6/2000 | Douta et al. |
| 6,079,204 | A | | 6/2000 | Sun et al. |
| 6,092,021 | A | | 7/2000 | Ehlbeck et al. |
| 6,092,369 | A | | 7/2000 | Hosogai et al. |
| 6,101,809 | A | | 8/2000 | Ishuzuka et al. |
| 6,102,019 | A | | 8/2000 | Brooks |
| 6,105,365 | A | | 8/2000 | Deeba et al. |
| 6,119,448 | A | * | 9/2000 | Emmerling et al. ..... 60/274 |
| 6,119,449 | A | | 9/2000 | Köhler |
| 6,128,899 | A | | 10/2000 | Oono et al. |
| 6,134,883 | A | | 10/2000 | Kato et al. |
| 6,138,453 | A | | 10/2000 | Sawada et al. |
| 6,145,302 | A | | 11/2000 | Zhang et al. |
| 6,145,305 | A | | 11/2000 | Itou et al. |
| 6,148,611 | A | | 11/2000 | Sato |
| 6,148,612 | A | | 11/2000 | Yamashita et al. |
| 6,161,378 | A | | 12/2000 | Hanaoka et al. |
| 6,161,428 | A | | 12/2000 | Esteghlal et al. |
| 6,164,064 | A | | 12/2000 | Pott |
| 6,189,523 | B1 | | 2/2001 | Weisbrod et al. |
| 6,199,373 | B1 | | 3/2001 | Hepburn et al. |
| 6,202,406 | B1 | | 3/2001 | Griffin et al. |
| 6,205,773 | B1 | | 3/2001 | Suzuki |
| 6,214,207 | B1 | | 4/2001 | Miyata et al. |
| 6,216,448 | B1 | | 4/2001 | Schnaibel et al. |

| | | | | |
|---|---|---|---|---|
| 6,216,451 | B1 | | 4/2001 | Schnaibel et al. |
| 6,233,923 | B1 | | 5/2001 | Itou et al. |
| 6,237,330 | B1 | | 5/2001 | Takahashi et al. |
| 6,244,046 | B1 | | 6/2001 | Yamashita |
| 6,314,723 | B1 | * | 11/2001 | Ketterer et al. ..... 60/277 |

FOREIGN PATENT DOCUMENTS

| | | |
|---|---|---|
| EP | 0 508 389 A1 | 1/1994 |
| JP | 62-97630 | 5/1987 |
| JP | 62-117620 | 5/1987 |
| JP | 64-53042 | 3/1989 |
| JP | 2-30915 | 2/1990 |
| JP | 2-33408 | 2/1990 |
| JP | 2-207159 | 8/1990 |
| JP | 3-135147 | 6/1991 |
| JP | 5-26080 | 2/1993 |
| JP | 5-106493 | 4/1993 |
| JP | 5-106494 | 4/1993 |
| JP | 6-58139 | 3/1994 |
| JP | 6-264787 | 9/1994 |
| JP | 7-97941 | 4/1995 |
| WO | WO 98/27322 | 6/1998 |

OTHER PUBLICATIONS

J. Theis et al., "An Air/Fuel Algorithm to Improve the $NO_x$ Conversion of Copper–Based Catalysts," SAE Technical Paper No. 922251, Oct. 19–22, 1992.

W. Wang, "Air–Fuel Control to Reduce Emissions, II. Engine–Catalyst Characterization Under Cyclic Conditions," SAE Technical Paper No. 800052, Feb. 25–29, 1980.

T. Yamamoto et al., "Dynamic Behavior Analysis to Three Way Catalytic Reaction," JSAE 882072–882166.

* cited by examiner

METHOD AND SYSTEM FOR REDUCING VEHICLE EMISSIONS USING A SENSOR DOWNSTREAM OF AN EMISSION CONTROL DEVICE

BACKGROUND OF THE INVENTION

1. Field of the Invention

The invention relates to methods and systems for the treatment of exhaust gas generated by "lean burn" operation of an internal combustion engine which are characterized by reduced tailpipe emissions of a selected exhaust gas constituent.

2. Background Art

Generally, the operation of a vehicle's internal combustion engine produces engine exhaust that includes a variety of constituent gases, including carbon monoxide (CO), hydrocarbons (HC), and nitrogen oxides ($NO_x$). The rates at which the engine generates these constituent gases are dependent upon a variety of factors, such as engine operating speed and load, engine temperature, spark timing, and EGR. Moreover, such engines often generate increased levels of one or more constituent gases, such as $NO_x$, when the engine is operated in a lean-burn cycle, i.e., when engine operation includes engine operating conditions characterized by a ratio of intake air to injected fuel that is greater than the stoichiometric air-fuel ratio, for example, to achieve greater vehicle fuel economy.

In order to control these vehicle tailpipe emissions, the prior art teaches vehicle exhaust treatment systems that employ one or more three-way catalysts, also referred to as emission control devices, in an exhaust passage to store and release selected exhaust gas constituents, such as $NO_x$, depending upon engine operating conditions. For example, U.S. Pat. No. 5,437,153 teaches an emission control device which stores exhaust gas $NO_x$ when the exhaust gas is lean, and releases previously-stored $NO_x$ when the exhaust gas is either stoichiometric or "rich" of stoichiometric, i.e., when the ratio of intake air to injected fuel is at or below the stoichiometric air-fuel ratio. Such systems often employ open-loop control of device storage and release times (also respectively known as device "fill" and "purge" times) so as to maximize the benefits of increased fuel efficiency obtained through lean engine operation without concomitantly increasing tailpipe emissions as the device becomes "filled." The timing of each purge event must be controlled so that the device does not otherwise exceed its capacity to store the selected exhaust gas constituent, because the selected constituent would then pass through the device and effect an increase in tailpipe emissions. The frequency of the purge is preferably controlled to avoid the purging of only partially filled devices, due to the fuel penalty associated with the purge event's enriched air-fuel mixture.

The prior art has recognized that the storage capacity of a given emission control device is itself a function of many variables, including device temperature, device history, sulfation level, and the presence of any thermal damage to the device. Moreover, as the device approaches its maximum capacity, the prior art teaches that the incremental rate at which the device continues to store the selected constituent, also referred to as the instantaneous efficiency of the device, may begin to fall. Accordingly, U.S. Pat. No. 5,437,153 teaches use of a nominal $NO_x$-storage capacity for its disclosed device which is significantly less than the actual $NO_x$-storage capacity of the device, to thereby provide the device with a perfect instantaneous $NO_x$-retaining efficiency, that is, so that the device is able to store all engine-generated $NO_x$ as long as the cumulative stored $NO_x$ remains below this nominal capacity. A purge event is scheduled to rejuvenate the device whenever accumulated estimates of engine-generated $NO_x$ reach the device's nominal capacity.

The amount of the selected constituent gas that is actually stored in a given emission control device during vehicle operation depends on the concentration of the selected constituent gas in the engine feedgas, the exhaust flow rate, the ambient humidity, the device temperature, and other variables including the "poisoning" of the device with certain other constituents of the exhaust gas. For example, when an internal combustion engine is operated using a fuel containing sulfur, the prior art teaches that sulfur may be stored in the device and may correlatively cause a decrease in both the device's absolute capacity to store the selected exhaust gas constituent, and the device's instantaneous constituent-storing efficiency. When such device sulfation exceeds a critical level, the stored $SO_x$ must be "burned off" or released during a desulfation event, during which device temperatures are raised above perhaps about 650° C. in the presence of excess HC and CO. By way of example only, U.S. Pat. No. 5,746,049 teaches a device desulfation method which includes raising the device temperature to at least 650° C. by introducing a source of secondary air into the exhaust upstream of the device when operating the engine with an enriched air-fuel mixture and relying on the resulting exothermic reaction to raise the device temperature to the desired level to purge the device of $SO_x$.

Thus, it will be appreciated that both the device capacity to store the selected exhaust gas constituent, and the actual quantity of the selected constituent stored in the device, are complex functions of many variables that prior art accumulation-model-based systems do not take into account. The inventors herein have recognized a need for a method and system for controlling an internal combustion engine whose exhaust gas is received by an emission control device which can more accurately determine the amount of the selected exhaust gas constituent, such as $NO_x$, stored in an emission control device during lean engine operation and which, in response, can more closely regulate device fill and purge times to optimize tailpipe emissions.

SUMMARY OF THE INVENTION

Under the invention, a method and system are provided for controlling an internal combustion engine that operates at a plurality of engine operating conditions characterized by combustion of air-fuel mixtures having different air-fuel ratios to generate engine exhaust gas, wherein the exhaust gas is directed through an exhaust treatment system including an emission control device that stores a selected exhaust gas constituent when the exhaust gas is lean and releases the stored selected exhaust gas constituent when the exhaust gas is rich, and a sensor operative to generate an output signal representative of a concentration of the selected constituent in the exhaust gas, such as $NO_x$, exiting the device. The method includes determining a first value representative of an instantaneous concentration of the selected constituent in the engine exhaust gas during a lean operating condition; determining a second value representative of the instantaneous concentration of the selected constituent exiting the device based on the output signal generated by the sensor; and selecting an engine operating condition as a function of the first and second values. More specifically, in a preferred embodiment, the first value is estimated using a lookup table containing mapped values for the concentration of the selected constituent in the engine feedgas as a function of instantaneous engine speed and load. A lean operating condition is terminated, and a rich operating condition suitable for purging the device of stored selected constituent is scheduled, when the device efficiency, calculated based on the first and second values, falls below a predetermined minimum efficiency value. In this manner, the storage of the selected constituent in the device and, hence, the "fill time" during which the engine is operated in a lean operating condition, is optimized without reliance upon an accumulation model, in the manner characteristic of the prior art.

In accordance with another feature of the invention, the method preferably includes calculating a differential value based on the first and second values, with the differential value being representative of the amount of the selected constituent instantaneously stored in the device; and the differential value is accumulated over time to obtain a first accumulated measure representative of the total amount of the selected constituent which has been stored in the device during lean engine operation. The method further preferably includes calculating the amount of fuel, in excess of the stoichiometric amount, which is necessary to purge the device of both stored selected constituent and stored oxygen, based on the first accumulated measure and a previously stored value representing the amount of excess fuel necessary to purge only stored oxygen from the device. The method also preferably includes accumulating a value representative of an instantaneous amount of fuel supplied to the engine in excess of a stoichiometric amount during a purge event to obtain a second accumulated measure; and terminating the purge event when the second accumulated measure exceeds the total excess fuel value. In this manner, the invention optimizes the amount of excess fuel used to purge the device and, indirectly, the device purge time.

In accordance with another feature of the invention, the method preferably includes selecting a device-desulfating engine operating condition when the device's calculated efficiency value falls below the minimum efficiency value and the first accumulated measure does not exceed a reference minimum-storage value for the selected constituent in the device. The method further preferably includes indicating device deterioration if a predetermined number of device-desulfating engine operating conditions are performed without any increase in a maximum value for the first accumulated measure.

In accordance with a further feature of the invention, the value representing the oxygen-only excess fuel amount is periodically updated using an adaption value which is itself generated by comparing the output signal of the sensor to a minimum-concentration reference value for the selected constituent upon terminating a scheduled purge. More specifically, the adaption value is generated as a function of any error between the output signal of the sensor and the minimum-concentration reference value.

The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
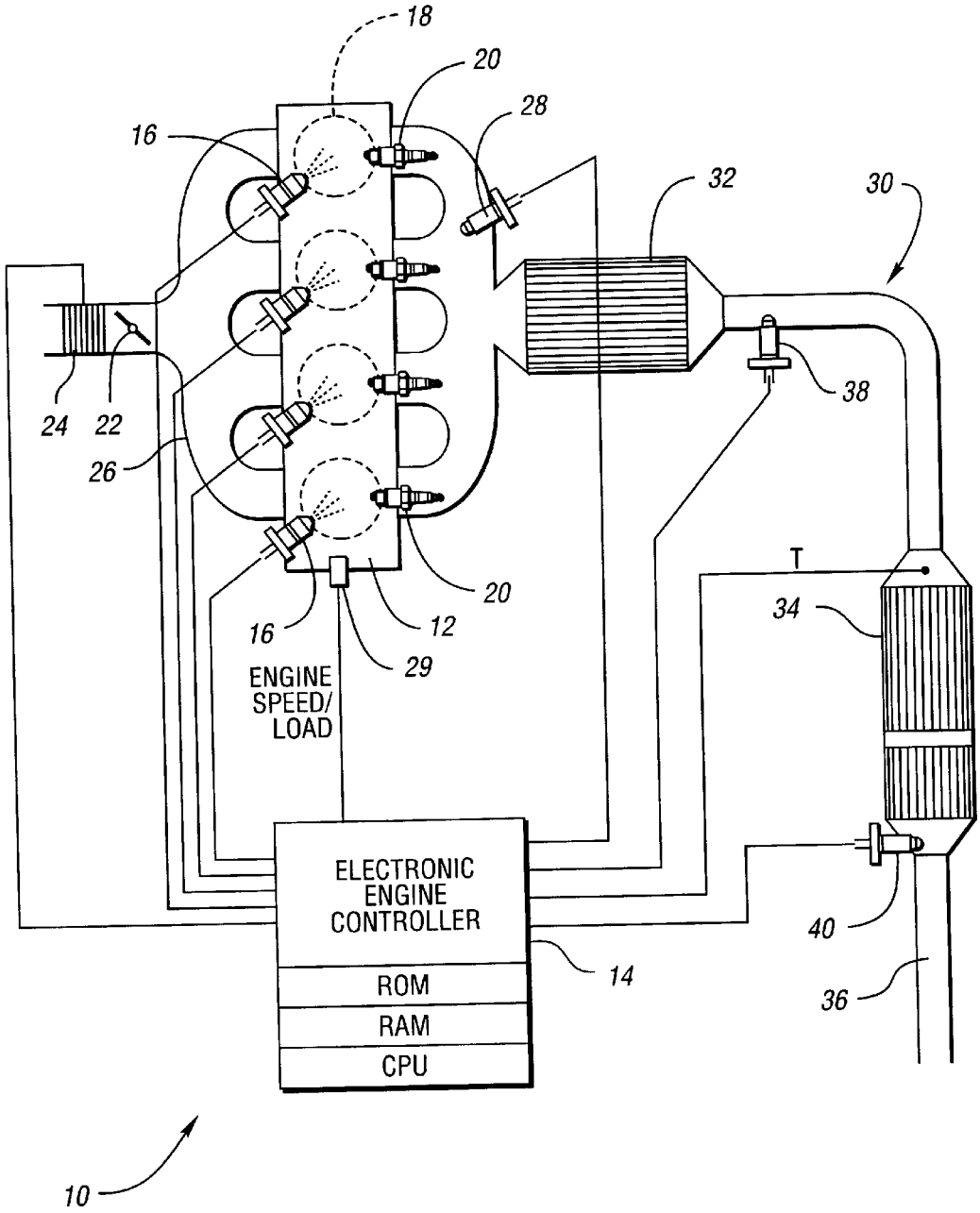
FIG. 1 is a schematic of an engine system for the preferred embodiment of the invention.

Referring to FIG. 1, an exemplary control system 10 for a four-cylinder, direct-injection spark-ignition gasoline-powered engine 12 for a motor vehicle includes an electronic engine controller 14 having ROM, RAM and a processor ("CPU") as indicated. The controller 14 controls the operation of a set of fuel injectors 16. The fuel injectors 16, which are of conventional design, are each positioned to inject fuel into a respective cylinder 18 of the engine 12 in precise quantities as determined by the controller 14. The controller 14 similarly controls the individual operation, i.e., timing, of the current directed through each of a set of spark plugs 20 in a known manner.

The controller 14 also controls an electronic throttle 22 that regulates the mass flow of air into the engine 12. An air mass flow sensor 24, positioned at the air intake of engine's intake manifold 26, provides a signal regarding the air mass flow resulting from positioning of the engine's throttle 22. The air flow signal from the air mass flow sensor 24 is utilized by the controller 14 to calculate an air mass value which is indicative of a mass of air flowing per unit time into the engine's induction system.

A first oxygen sensor 28 coupled to the engine's exhaust manifold detects the oxygen content of the exhaust gas generated by the engine 12 and transmits a representative output signal to the controller 14. The first oxygen sensor 28 provides feedback to the controller 14 for improved control of the air-fuel ratio of the air-fuel mixture supplied to the engine 12, particularly during operation of the engine 12 at or near the stoichiometric air-fuel ratio which, for a constructed embodiment, is about 14.65. A plurality of other sensors, including an engine speed sensor and an engine load sensor, indicated generally at 29, also generate additional signals in a known manner for use by the controller 14.

An exhaust system 30 transports exhaust gas produced from combustion of an air-fuel mixture in each cylinder 18 through a pair of emission control devices 32,34. A second oxygen sensor 38, which may also be a switching-type HEGO sensor, is positioned in the exhaust system 30 between the first and second devices 32,34. In a constructed embodiment, the first and second oxygen sensors 28,38 are "switching" heated exhaust gas oxygen (HEGO) sensors; however, the invention contemplates use of other suitable sensors for generating a signal representative of the oxygen concentration in the exhaust manifold and exiting the first device 32, respectively, including but not limited to exhaust gas oxygen (EGO) type sensors, and linear-type sensors such as universal exhaust gas oxygen (UEGO) sensors.

Figure 2:
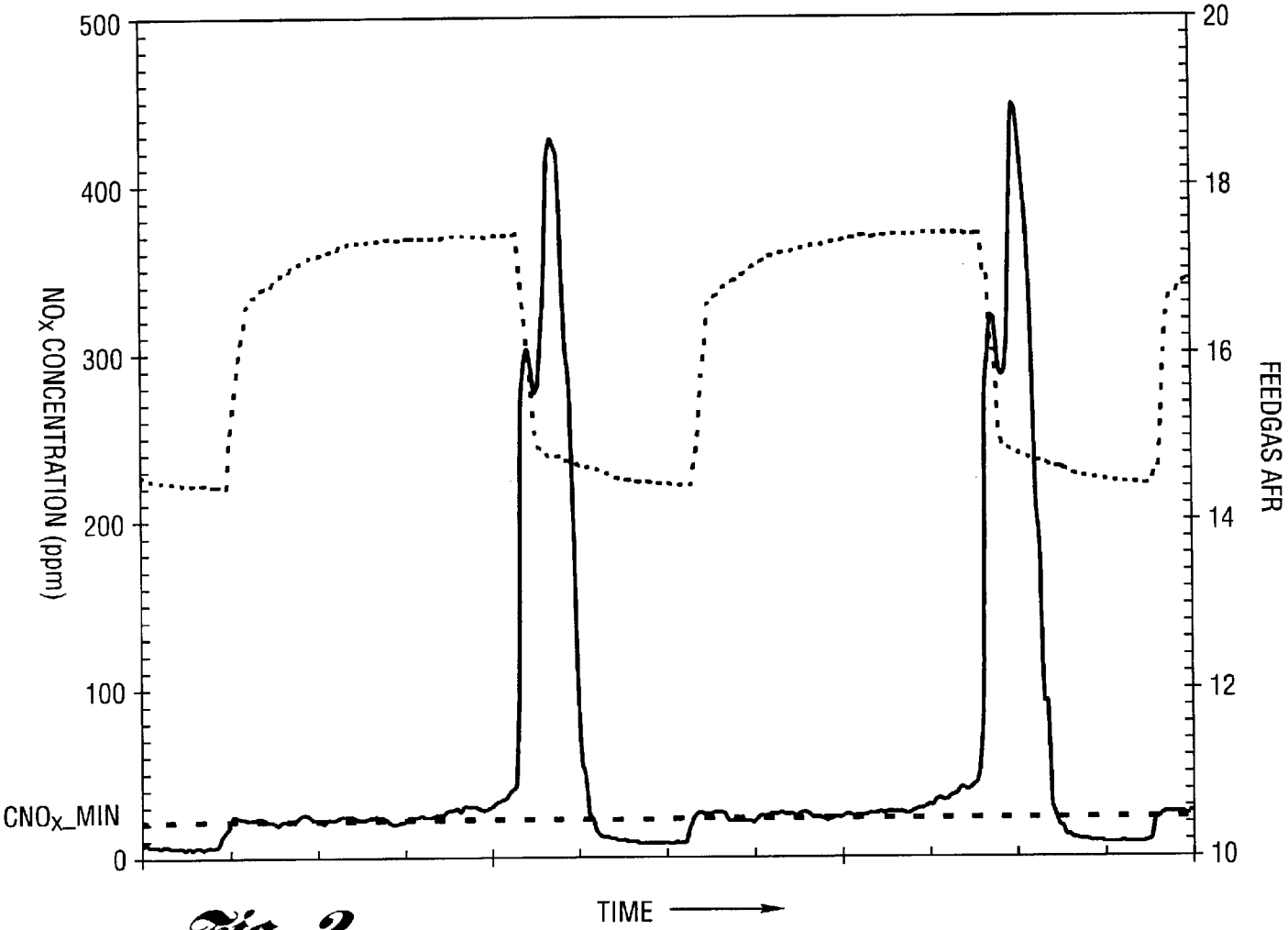
FIG. 2 is a plot of both the output signal generated by a downstream exhaust gas constituent sensor, specifically, the system's $NO_x$ sensor, and the feedgas air-fuel ratio during cyclical operation of the engine between a lean operating condition and a device-purging rich operation condition.

In accordance with the invention, a $NO_x$ sensor 40 is positioned in the exhaust system 30 downstream of the second device 34. The $NO_x$ sensor 40 generates an output signal CNOx which is representative of the instantaneous concentration of a selected exhaust gas constituent ($NO_x$) in the exhaust gas exiting the second device 34. FIG. 2 contains a plot illustrating an exemplary output signal CNOx generated by the $NO_x$ sensor 40 during a cyclical operation of the engine 12 between a lean operating condition and a second device-purging rich operation condition, along with an exemplary output signal generated by the second oxygen sensor 38 representing the exhaust gas oxygen concentration immediately upstream of the second device 34.

Figure 3:
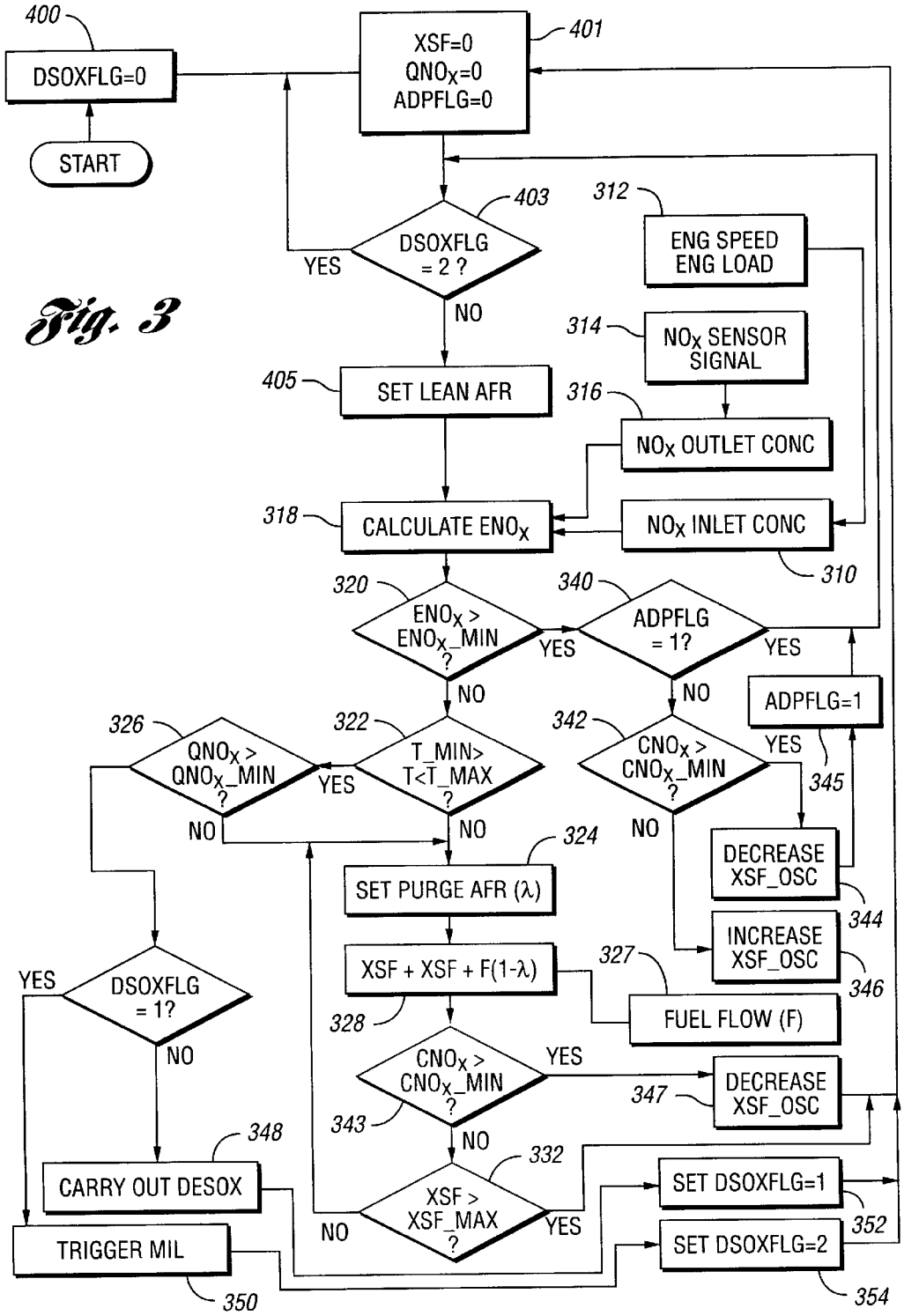
FIG. 3 is a flowchart illustrating the steps of the control process employed by the exemplary system.

A flowchart illustrating the steps of the control process employed by the exemplary system 10 is shown in FIG. 3.

Specifically, upon commencing lean engine operation, the controller 14 estimates in step 310 the instantaneous concentration of "feedgas" $NO_x$, i.e., the concentration of $NO_x$ in the engine exhaust as a result of the combustion of the air-fuel mixture with in the engine 12, as a function of instantaneous engine operating conditions (312). By way of example only, in a preferred embodiment, the controller 14 retrieves a stored estimate for instantaneously feedgas $NO_x$ concentration from a look-up table stored in ROM, originally obtained from engine mapping data. Because the controller 14 receives the output signal generated by the downstream $NO_x$ sensor 40 in step 314, which provides a direct measure of the $NO_x$, concentration in the exhaust gas flowing out of the second device 34 in step 316, the controller 14 calculates in step 318 both the instantaneous $NO_x$-absorbing efficiency ENOx of the second device 34, and an accumulated measure QNOx representative of the amount of $NO_x$ which has been absorbed or stored in the second device 34 (the difference between the estimated feedgas $NO_x$ concentration and the concentration of $NO_x$ exiting the second device 34, accumulated over time).

The controller 14 then compares the instantaneous $NO_x$-absorbing efficiency ENOx to a reference value ENOx_MIN in step 320. If the instantaneous $NO_x$-absorbing efficiency ENOx falls below the reference value ENOx_MIN, the controller 14 then compares in step 322 the instantaneous second device temperature T to predetermined values T_MIN and T_MAX for minimum and maximum device operating temperatures, respectively, to ensure that the low instantaneous device efficiency is not due to operating the second device 34 outside of its design temperature range. If the second device temperature T is not within the proper operating range, the controller 14 terminates lean engine operation, and a second device purge event is scheduled in step 324.

If, however, the second device temperature T is within the proper operating range, the controller 14 then compares (in step 326) the accumulated measure QNOx to a minimum reference value QNOx_MIN to rule out whether the low instantaneous device efficiency is the result of a nearly-full second device 34. If the accumulated measure QNQx is greater than the minimum reference value QNOx_MIN, the controller 14 schedules a purge event in step 324. If the accumulated measure QNOx is less than the minimum reference value QNOx_MIN, the low instantaneous device efficiency is the result of sulfur accumulation within the second device 34, or other device deterioration. The controller 14 then schedules a desulfation event, as described more fully below.

Upon the scheduling of a purge event in step 324, the controller 14 switches the air-fuel ratio of the air-fuel mixture supplied to each of the engine's cylinders from lean to rich. During the purge event, the controller 14 integrates over time the amount of "excess" fuel supplied to the engine, i.e., the amount which the supplied fuel (327) exceeds that which is required for stoichiometric engine operation, to obtain a representative excess fuel measure XSF in step 328. In the meantime, the controller 14 calculates an excess fuel reference value XSF_MAX representing the amount of excess fuel that is required to purge the second device 34 of the calculated amount QNOx of stored $NO_x$. More specifically, XSF_MAX is directly proportional to the quantity of $NO_x$ stored and is determined according to the following expression:

$$XSF_MAX = K \times QNOx + XSF_OSC,$$

where K is a proportionality constant between the quantity of $NO_x$ stored and the amount of excess fuel; and XSF_OSC is a previously-calculated value representative of the quantity of excess fuel required to release oxygen stored within the second device 34, as discussed further below.

When the amount of excess fuel XSF delivered to the engine exceeds the calculated maximum value XSF_MAX in step 332, the controller 14 terminates the purge event, whereupon the controller 14 returns engine operation to either a near-stoichiometric operation or, preferably, a lean operating condition.

The controller 14 periodically adapts (flag ADPFLG) a stored value XSF_OSC representative of the quantity of excess fuel required to release oxygen that was previously stored within the second device 34 during lean engine operation, using the following adaptive procedure starting at step 340: when the $NO_x$ is completely purged from the second device 34, the $NO_x$ concentration in the exhaust gas exiting the second device 34 and, hence, the output signal of the downstream $NO_x$ sensor 40 will fall below a predetermined reference value CNOX_MIN determined in step 342 or 343. If the actual purge time is greater than the time required for the tailpipe $NO_x$ concentration to drop below the reference value CNOX_MIN, the controller 14 determines that the second device 34 has been "overpurged", i.e., a greater amount of excess fuel has been provided than was otherwise necessary to purge the second device 34 of stored $NO_x$ and stored oxygen, and the controller 14 reduces the stored value XSF_OSC in steps 344 and 347 and then sets flag ADPPLG to 1 in step 345. On the other hand, if the measured $NO_x$ concentration in the exhaust gas exiting the second device 34 does not fall below the reference value CNOx_MIN, the controller 14 determines that the second device 34 has not been fully purged of stored $NO_x$ and stored oxygen, and the stored value XSF_OSC is increased accordingly in step 346.

In accordance with another feature of the invention, the controller 14 uses accumulated measure QNOx representative of the amount of $NO_x$ which has been absorbed or stored in the second device 34 for diagnostic purposes. For example, in a preferred embodiment, as described above, a second device desulfation event is preferably scheduled in step 348 when the second device's instantaneous efficiency ENOx drops below a minimum efficiency ENQx_MIN and the accumulated $NO_x$-storage measure QNOx falls below a predetermined reference value QNQx_MIN, notwithstanding continued second device operation in the proper temperature range. Moreover, if the accumulated $NO_x$-storage measure QNOx is still less than the reference value QNQx_MIN after completion of the desulfation event, a malfunction indicator code is triggered, and lean engine operation is terminated in step 350. Also, flag DSOXFG is set in steps 352 and 354.

Also, in steps 400 and 401, parameters XSF, QNOx, and flags ADPFLG and DSOXFLG are set to zero. Then, DSOXFLG is checked at step 403. A lean air/fuel is then set at step 405.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. A method of controlling an engine that operates at a plurality of engine operating conditions characterized by combustion of air-fuel mixtures having different air-fuel ratios to generate engine exhaust gas, wherein the exhaust gas is directed through an exhaust treatment system including an emission control device that stores a selected exhaust gas constituent when the exhaust gas is lean and releases the stored selected exhaust gas constituent when the exhaust gas is rich, and a sensor operative to generate an output signal representative of a concentration of the selected constituent in the exhaust gas exiting the device, the method comprising:

determining a first value representative of an instantaneous concentration of the selected constituent in the engine exhaust gas when operating in the lean operating condition;

determining a second value representative of the instantaneous concentration of the selected constituent exiting the device based on the output signal generated by the sensor; and selecting an engine operating condition as a function of the first and second values, wherein selecting includes calculating, during the lean operating condition, an efficiency value based on the first and second values; and terminating the lean operating condition when the efficiency value falls below a minimum efficiency value.

2. The method of claim 1, wherein determining the first value includes estimating the first value as a function of at least one of the group consisting of an engine speed and an engine load.

3. A method of controlling an engine that operates at a plurality of engine operating conditions characterized by combustion of air-fuel mixtures having different air-fuel ratios to generate engine exhaust gas, wherein the exhaust gas is directed through an exhaust treatment system including an emission control device that stores a selected exhaust gas constituent when the exhaust gas is lean and releases the stored selected exhaust gas constituent when the exhaust gas is rich, and a sensor operative to generate an output signal representative of a concentration of the selected constituent in the exhaust gas exiting the device, the method comprising:

determining a first value representative of an instantaneous concentration of the selected constituent in the engine exhaust gas when operating in the lean operating condition;

determining a second value representative of the instantaneous concentration of the selected constituent exiting the device based on the output signal generated by the sensor; and selecting an engine operating condition as a function of the first and second values, wherein selecting includes:

calculating a differential value based on the first and second values;

accumulating the differential value over time to obtain a first accumulated measure representative of an amount of the selected constituent stored in the device;

calculating a total excess fuel value representative of an amount of fuel in excess of a stoichiometric amount of fuel that is required to release stored selected constituent and stored oxygen from the device as a function of the first accumulated measure and a previously stored oxygen-only excess fuel value representative of an amount of excess fuel required to release only stored oxygen from the device; and supplying an amount of fuel to the engine in excess of the stoichiometric amount based on the excess fuel value.

4. The method of claim 3, wherein supplying includes:

accumulating a value representative of an instantaneous amount of excess fuel supplied to the engine during a given engine operating condition to obtain a second accumulated measure; and terminating the given engine operating condition when the second accumulated measure exceeds the total excess fuel value.

5. The method of claim 4, further including:

comparing the output signal of the sensor to a minimum-concentration reference value upon terminating the given engine operating condition; and generating an adaption value for modifying the oxygen-only excess fuel value as a function of any error between the output signal of the sensor and the minimum-concentration reference value.

6. The method of claim 3, wherein selecting includes:

calculating, during the lean operating condition, a device efficiency value based on the first and second value; and selecting a device-desulfating engine operating condition when the efficiency value falls below a minimum efficiency value and the first accumulated measure does not exceed a reference minimum-storage value for the selected constituent in the device.

7. The method of claim 6, further including indicating device deterioration if a predetermined number of device-desulfating engine operating conditions are performed without any increase in a maximum value for the first accumulated measure.

8. A system for controlling an internal combustion engine that operates at a plurality of engine operating conditions characterized by combustion of air-fuel mixtures having different air-fuel ratios, wherein exhaust gas generated by such combustion is directed through an exhaust treatment system including an emission control device that stores a selected exhaust gas constituent when the exhaust gas is lean and releases the stored selected constituent when the exhaust gas is rich, and a sensor operative to generate an output signal representative of a concentration of a selected constituent of the exhaust gas exiting the device, the system comprising:

a controller including a microprocessor arranged to determine a first value representative of an instantaneous concentration of the selected constituent in the engine exhaust gas when operating in a lean operating condition, and to determine a second value representative of the instantaneous concentration of the selected constituent exiting the device based on the output signal generated by the sensor, and wherein the controller is further arranged to select an engine operating condition as a function of the first and second values, wherein the controller is further arranged to calculate a differential value based on the first and second values, to accumulate the differential value over time to obtain a first accumulated measure representative of an amount of the selected constituent stored in the device, to calculate a total excess fuel value representative of an amount of fuel in excess of a stoichiometric amount of fuel that is required to release stored selected constituent and stored oxygen from the device as a function of the first accumulated measure and a previously stored oxygen-only excess fuel value representative of an amount of excess fuel required to release only stored oxygen from the device, and to supply an amount of fuel to the engine in excess of the stoichiometric amount based on the excess fuel value.

9. The system of claim 8, wherein the controller is further arranged to accumulate a value representative of an instantaneous amount of excess fuel supplied to the engine during a given engine operating condition to obtain a second accumulated measure, and to terminate the given engine operating condition when the second accumulated measure exceeds the total excess fuel value.

10. The system of claim 9, wherein the controller is further arranged to compare the output signal of the sensor to a minimum-concentration reference value for the selected constituent upon terminating the given engine operating condition, and to generate an adaption value for modifying the oxygen-only excess fuel value as a function of any error between the output signal of the sensor and the minimum-concentration reference value.

11. The system of claim 8, wherein the controller is further arranged to calculate, during the lean operating condition, a device efficiency value based on the first and second value, and to select a device-desulfating engine operating condition when the efficiency value falls below a minimum efficiency value and the first accumulated measure does not exceed a reference minimum-storage value for the selected constituent in the device.

12. The system of claim 11, wherein the controller is further arranged to indicate device deterioration if a predetermined number of device-desulfating engine operating conditions are performed without any increase in a maximum value for the first accumulated measure.

* * * * *